US007437100B2

(12) United States Patent
Kiryu

(10) Patent No.: US 7,437,100 B2
(45) Date of Patent: Oct. 14, 2008

(54) IMAGE FORMING APPARATUS

(75) Inventor: Koji Kiryu, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 235 days.

(21) Appl. No.: 11/503,264

(22) Filed: Aug. 14, 2006

(65) Prior Publication Data

US 2007/0041753 A1 Feb. 22, 2007

(30) Foreign Application Priority Data

Aug. 18, 2005 (JP) ..... 2005-237304

(51) Int. Cl.
*G03G 15/00* (2006.01)

(52) U.S. Cl. ..... 399/167; 399/301

(58) Field of Classification Search ..... 399/159, 399/162, 167, 298, 299, 301, 302, 308
See application file for complete search history.

(56) References Cited

U.S. PATENT DOCUMENTS

| | | | | |
|---|---|---|---|---|
| 6,771,919 | B2 * | 8/2004 | Koide | 399/167 |
| 7,099,614 | B2 * | 8/2006 | Koizumi | 399/301 |
| 7,239,833 | B2 * | 7/2007 | Tomita et al. | 399/299 |
| 7,343,119 | B2 * | 3/2008 | Matsuda et al. | 399/167 |
| 7,376,375 | B2 * | 5/2008 | Kobayashi et al. | 399/301 |

FOREIGN PATENT DOCUMENTS

| | | |
|---|---|---|
| JP | 10-078734 | 3/1998 |
| JP | 10-119355 | 5/1998 |
| JP | 2002-072816 | 3/2002 |

* cited by examiner

*Primary Examiner*—Hoan H Tran
(74) *Attorney, Agent, or Firm*—Harness, Dickey & Pierce, P.L.C.

(57) ABSTRACT

The color offset is reduced with a simple system by relative removal of speed variation components between drums of a tandem color image forming apparatus. Assuming that the speed variation of a magenta photosensitive drum is the largest, the speed variation components of various colors are subtracted from the speed variation component relating to magenta, and the results are added to the respective speed target values. The rotational speed differences of the photosensitive drums of various colors are eliminated by applying the same speed variation component as in the case of magenta to the rotational speed of the photosensitive drums of various colors other than magenta. Phase correction is performed with respect to the phase differences produced by the fact that the distance between drums of various colors is different from the drum peripheral length. Since the phase difference of the photosensitive drums is then zero at the transfer positions of various colors, the effect of speed variation is prevented from appearing in the image as color offset.

4 Claims, 14 Drawing Sheets

$$\text{PHASE CORRECTION VALUE} = \frac{\text{DISTANCE BETWEEN PHOTOSENSITIVE DRUM WHOSE SPEED UNEVENNESS IS LARGEST AND PHOTOSENSITIVE DRUM OF VARIOUS COLORS}}{\text{PERIPHERAL LENGTH OF PHOTOSENSITIVE DRUM}} \times 2\pi$$

IMAGE FORMING APPARATUS

BACKGROUND OF THE INVENTION

1. Field of the Invention

The present invention relates to an image forming apparatus and in particular relates to an image forming apparatus whereby color offset is prevented by correcting rotational speed variations of tandem photosensitive drums.

2. Description of the Related Art

Conventional color image forming systems include: the intermediate transfer system, in which toner images are formed, one color at a time, on a single photosensitive drum and these are successively transferred onto a transfer member to form the color image; and the tandem system, in which a plurality of photosensitive drums are arranged adjacently, toner images are formed, one color at a time, on each photosensitive drum, and are transferred onto a transfer member that is successively moved past these. Of these, greatest speed can be achieved with the tandem system, since operation can be effected with a plurality of photosensitive drums substantially at the same time in synchronized fashion.

With this tandem system, since a plurality of toner images are superimposed, it is necessary to drive the plurality of photosensitive drums without rotational speed variation and in precisely synchronized fashion. Conventionally, a method was employed wherein the plurality of photosensitive drums were brought into contact with a drive gear and the drums were rotated using a single photosensitive drum drive motor. With this method, the surface speed of the photosensitive drums is greatly affected by eccentricity or pitch variation of the drive gear. The method of eliminating the effects of eccentricity or pitch variation of the drive gear by providing photosensitive drum drive motors for each respective photosensitive drum so that the respective photosensitive drums are individually driven is therefore frequently adopted.

However, even if this method is adopted, it is difficult to completely eliminate variation of the speed of rotation of the photosensitive drums due to the effects of for example manufacturing variations of the motor for driving the photosensitive drums or mounting accuracy of the photosensitive drums themselves, or eccentricity of the drum shafts. Accordingly, the technique has been proposed of reducing speed variation of the photosensitive drums by detecting the rotational speed of the photosensitive drums and subjecting this to Fourier transformation so as to extract a variation component of arbitrary frequency and correcting the rotational speed by inverse phase data of this variation component.

The color image forming apparatus disclosed in Laid-open Japanese Patent Application No. 2002-72816, in which rotational speed variation of the rotary body is prevented, constitutes drive means that drives a rotary body in rotation. A frequency signal proportional to the rotational speed of the drive means is output by first speed detection means. A frequency signal proportional to the rotational speed of the rotary body is output by second speed detection means. Fourier transformation processing of the signal that is output by the second speed detection means is performed by Fourier transformation means. The correction data calculation means extracts a specific frequency component that is the subject of correction, and calculates and generates correction data from the frequency and amplitude thereof. The correction data calculated by the correction data calculation means is stored in correction data storage means. Drive control means controls the speed of rotation of the drive means using the detection signals of the first speed detection means and second speed detection means, and the correction data that is read from the correction data storage means.

The color image forming apparatus disclosed in Laid-open Japanese Patent Application No. H10-119355 reduces overshoot and undershoot generated when the speed of rotation of a polygonal motor is changed. An encoder detection circuit outputs encoder pulses in response to variation of the rotational speed of a photosensitive drum. A timer circuit outputs the amount of variation (count data) of the rotational speed of the photosensitive drum in unit control time (between encoder pulses). A calculation circuit finds the speed data by converting from count data to polygonal mirror rotational speed, and stores the result in RAM. An addition circuit adds reference rotational speed amount data to the speed data. A drive pulse generator generates a plurality of control signals from, the data obtained by the addition circuit. The polygonal motor driver controls the polygonal motor.

In the color image forming apparatus disclosed in Japanese Patent Number 3186610, AC color range offset can be reduced by suppressing to an appropriate and satisfactory extent cyclical rotational variations produced by for example eccentricity caused by the various types of rotary bodies themselves, such as the image carrier constituted by the photosensitive drum, transfer belt or intermediate transfer body belts, that are driven in rotation, or that are caused by the mounting thereof, eccentricity due to clearance errors of the drive shafts of the rotary bodies, or unevenness of belt thickness. The phase difference of the position of latent image writing on the image carrier and the transfer position is roughly 180°. A pattern for detection purposes that is formed on the endless carrier or the like is detected by pattern detection means. The drive control means performs control so as to effect individual fine adjustment of the rotational speeds of the rotary bodies such as the image carrier or endless carrier such as to cancel the variations of rotational speed thereof, by using amplitude component information relating to cyclical variation of rotational speed obtained by the detection means.

However, although speed variations of arbitrary period can be suppressed with these conventional methods, they cannot be completely removed. Also, two rotational speed detection devices are necessary for each photosensitive drum drive system. A further problem is that the device is made complicated by Fourier transformation of the rotational speed of the photosensitive drum, extraction of the correction frequency and computation of the correction data. A further problem is that, since control is not performed between the photosensitive drums, any speed variation component that has not been completely removed directly gives rise to color offset, which appears in the image.

SUMMARY OF THE INVENTION

An object of the present invention is solve the problems described above of the prior art and to provide an image forming apparatus whereby color offset can be reduced with a simple system by relative removal of speed variation components between photosensitive drums.

In accordance with the present invention, there is provided an image forming apparatus, comprising: a conveyor belt that conveys paper; an intermediate transfer belt that transfers a toner image; a plurality of photosensitive drums of the same shape adjacently arranged facing the intermediate transfer belt; an image forming unit that forms a monochromatic toner image on each of the photosensitive drums; a rotational speed detection device that detects individually the rotational speed of the photosensitive drums and the intermediate transfer belt; a control device that controls individually the rotational speed of the intermediate transfer belt and the photosensitive drums, using the detected value of rotational speed; a transfer device that transfers toner images of various colors formed on the photosensitive drums onto the intermediate transfer belt in sequentially superimposed fashion; a drive device that rotates the photosensitive drums with a constant target speed when power is switched on; a speed unevenness detection device that detects speed unevenness of the photosensitive drums from the rotational speed detection device of the photosensitive drums; a phase correction device that performs phase correction on the speed of the photosensitive drum of largest speed unevenness; and a target speed value calculation device that obtains a target speed value of the photosensitive drums by subtracting the speed unevenness of the other photosensitive drums from the speed value after phase correction.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Before describing the present invention, the prior art will be described with reference to the drawings.

Figure 1:
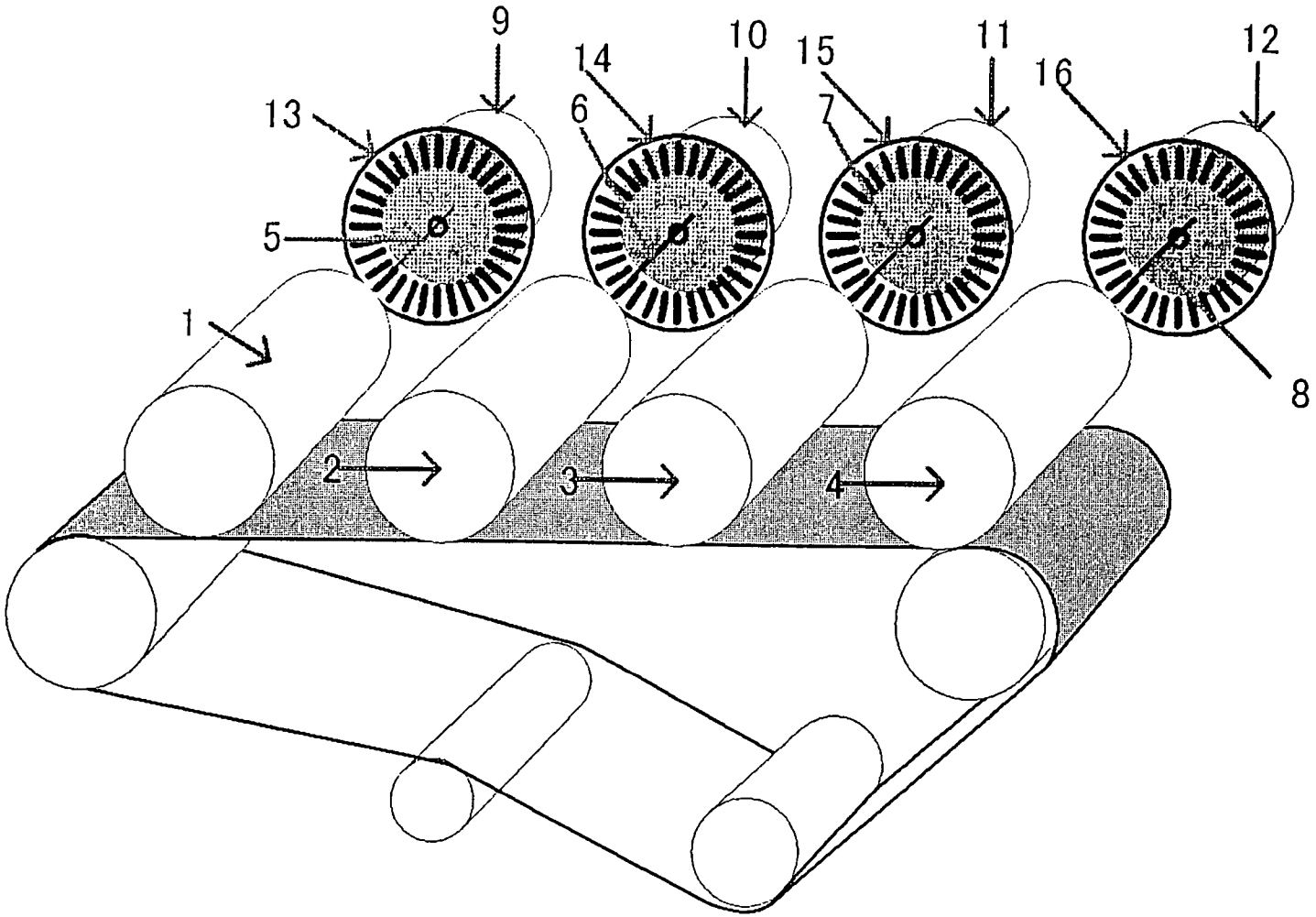
FIG. 1 PRIOR ART
FIG. 1 is a constructional diagram showing an example of a prior art photosensitive drum drive mechanism.
Figure 2A:
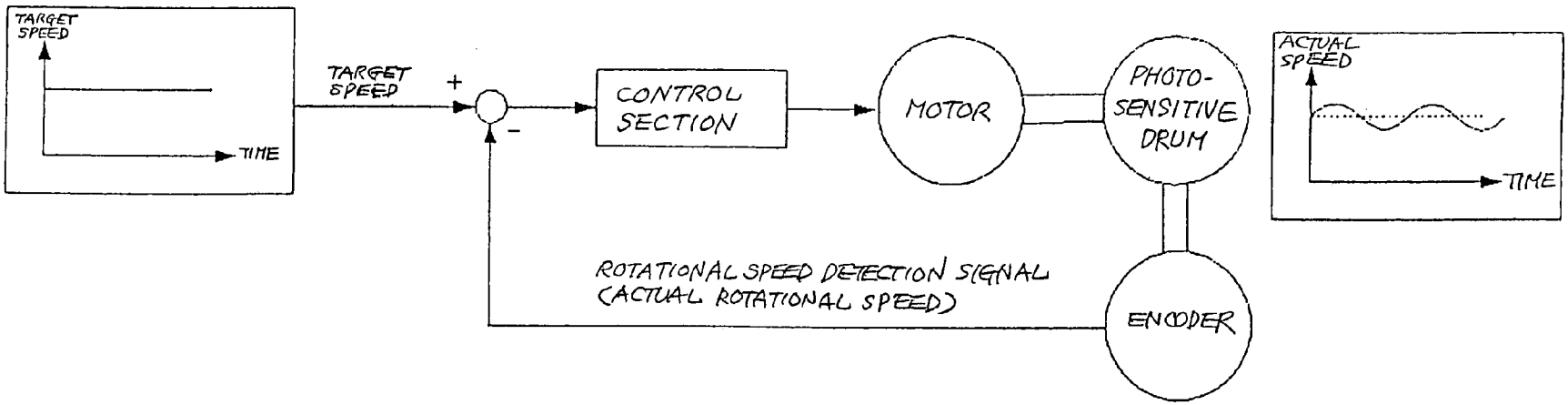
FIG. 2A PRIOR ART
FIGS. 2A to 2D are block diagrams showing the construction of a control system of the photosensitive drum drive mechanism thereof.
Figure 2B:
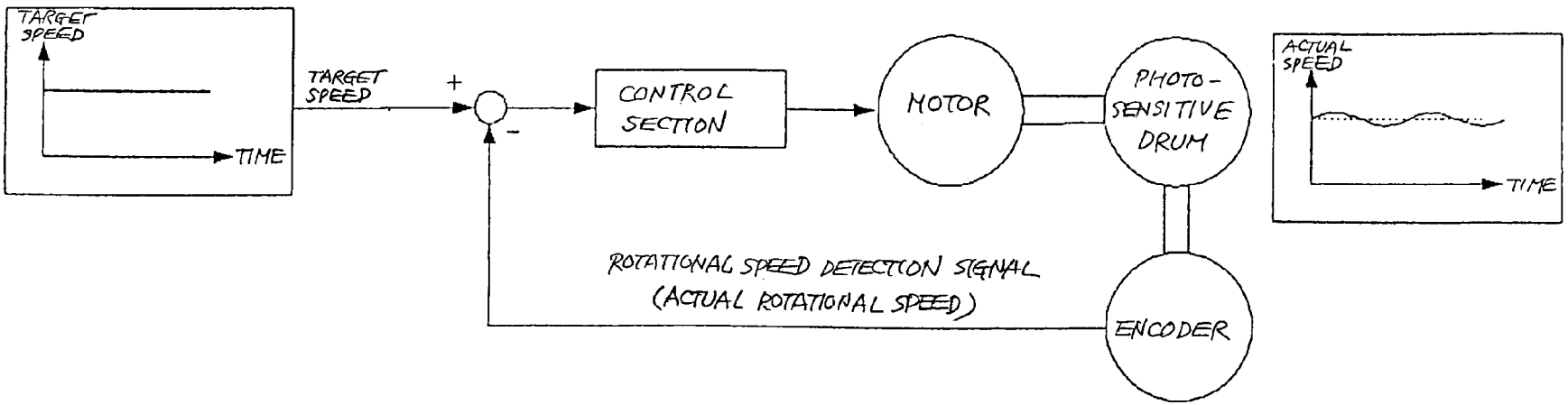
FIG. 2B PRIOR ART
Figure 2C:
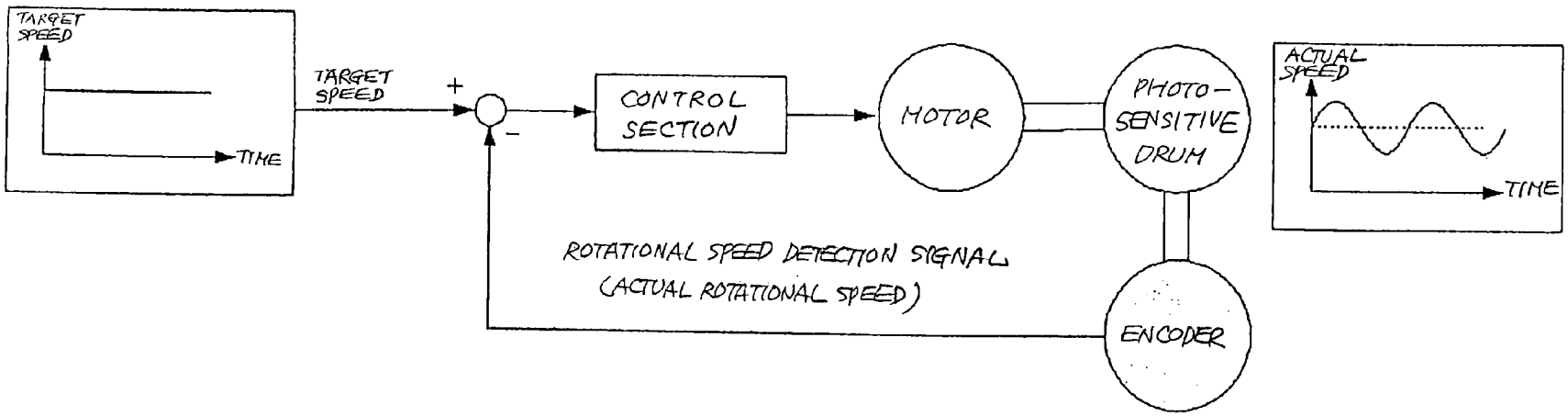
FIG. 2C PRIOR ART
Figure 2D:
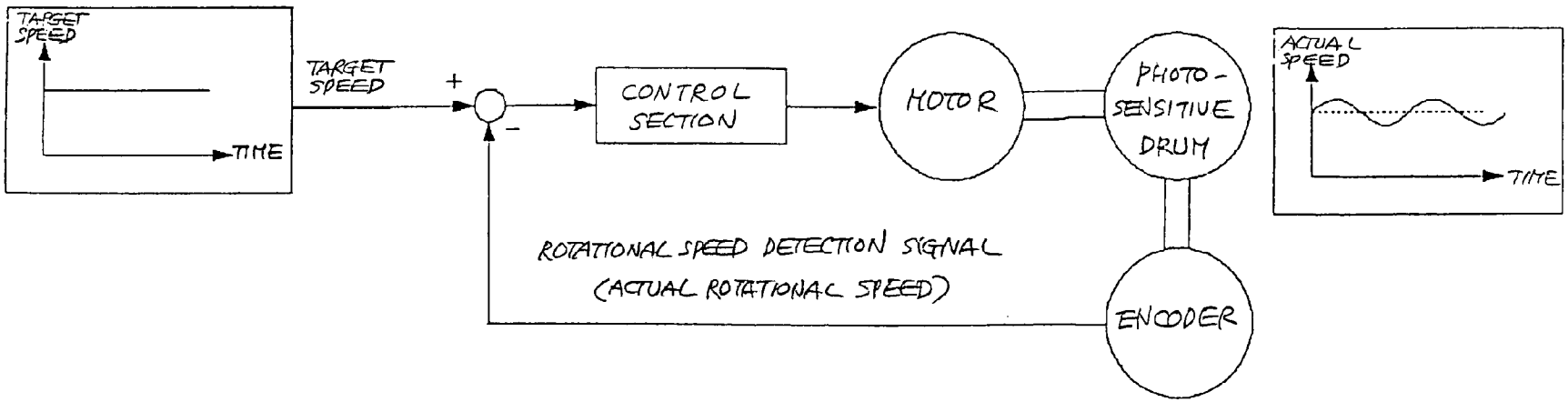
FIG. 2D PRIOR ART

FIG. 1 is a constructional diagram of a prior art photosensitive drum drive mechanism.

As shown in the Figure, in this drive mechanism, drive shafts 5 to 8 are provided for driving photosensitive drums 1 to 4 provided in respect of each color (black, yellow, cyan or magenta). A brushless motor 9 is provided in order to drive the drive shaft 5 of the black photosensitive drum 1, and, likewise, brushless motors 10 to 12 are provided in order to drive the drive shafts 6 to 8 of the photosensitive drums 2 to 4 for the three colors (yellow, cyan and magenta). The rotational speed of the brushless motors 9 to 12 is detected by the encoders 13 to 16 provided on the motor shafts of the brushless motors 9 to 12 and is fed back to the motor control unit thereof.

FIGS. 2A to 2D show the construction of a control system of the photosensitive drum drive mechanism thereof. In this control system, individual speed control and was performed by inputting constant values as the speed target values of the brushless motors 9 to 12 of the respective colors and feeding back to the speed target values the actual speed detected by the encoders 13 to 16.

Figure 3:
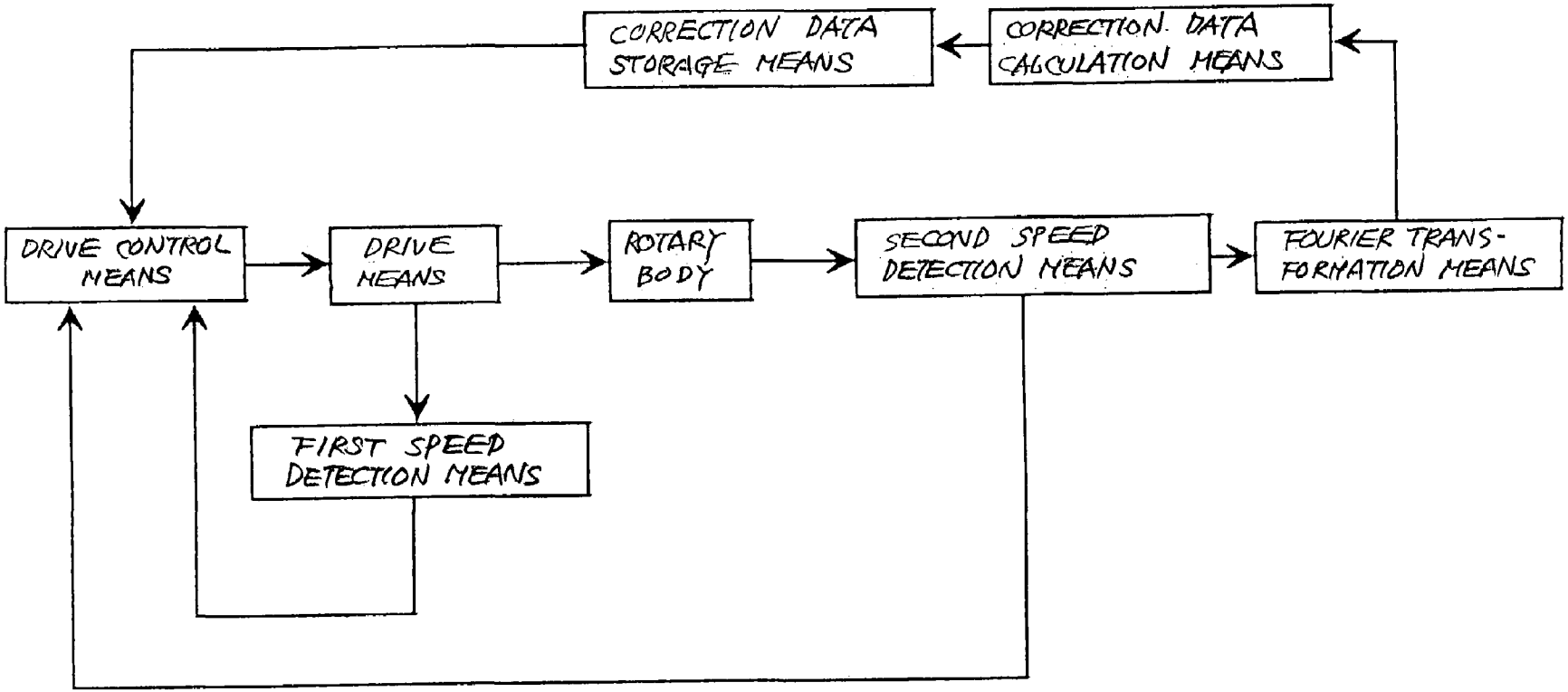
FIG. 3 PRIOR ART
FIG. 3 is a block diagram showing the construction of prior art speed control means.
Figure 4:
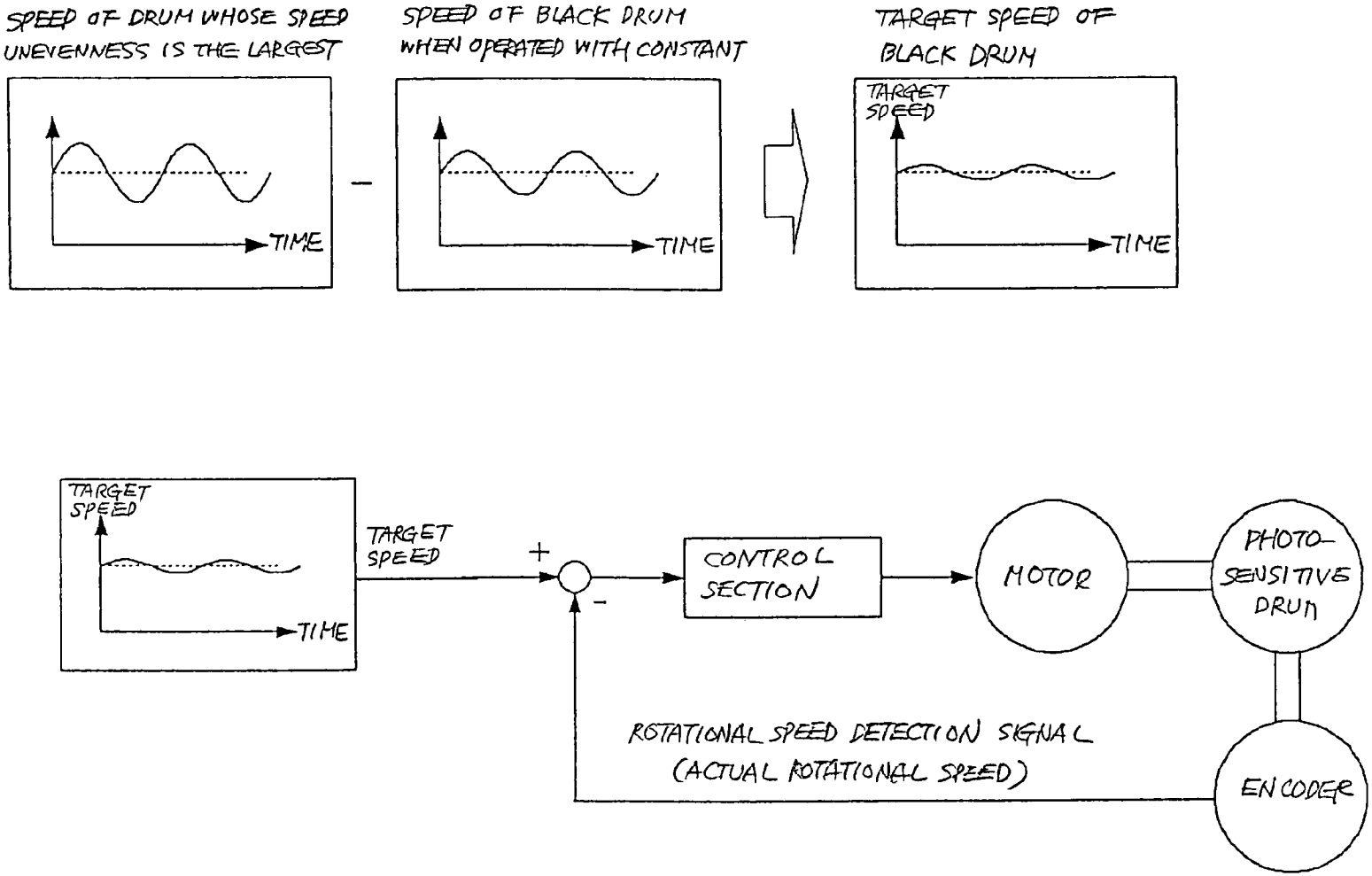
FIGS. 4 to 7 are block diagrams showing the construction of a photosensitive drum drive system of an image forming apparatus according to a first embodiment of the present invention.
Figure 5:
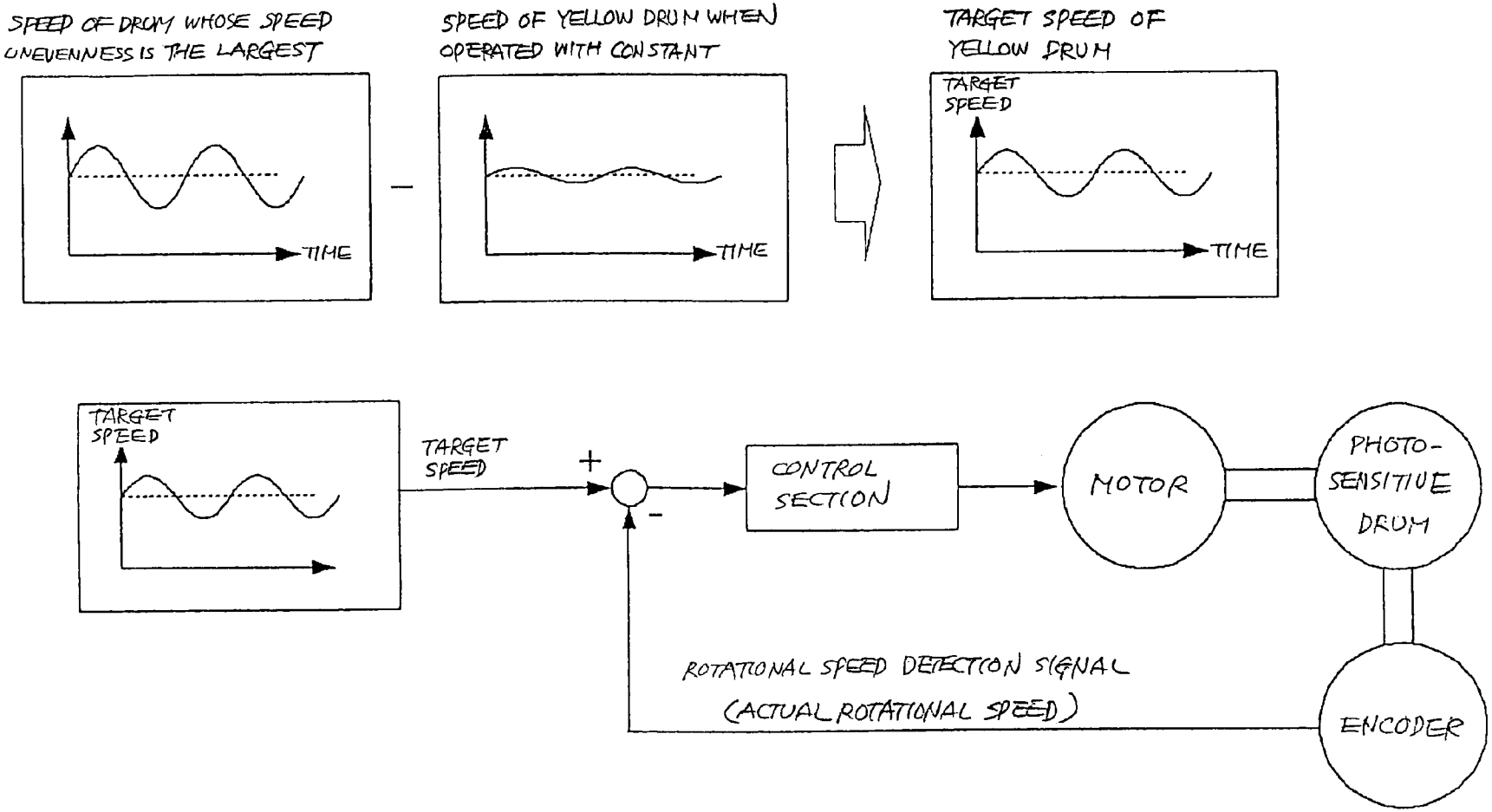
Figure 6:
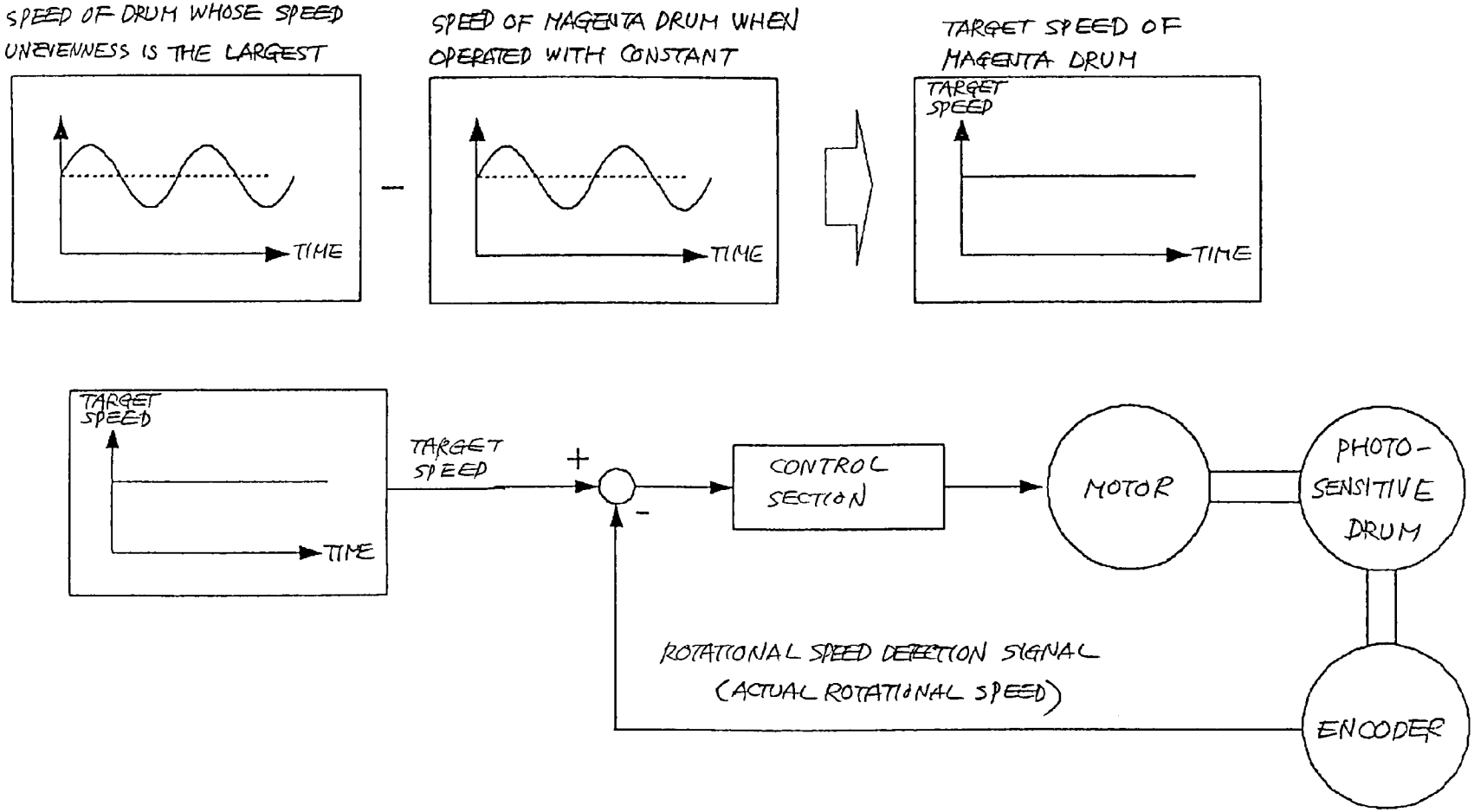
Figure 7:
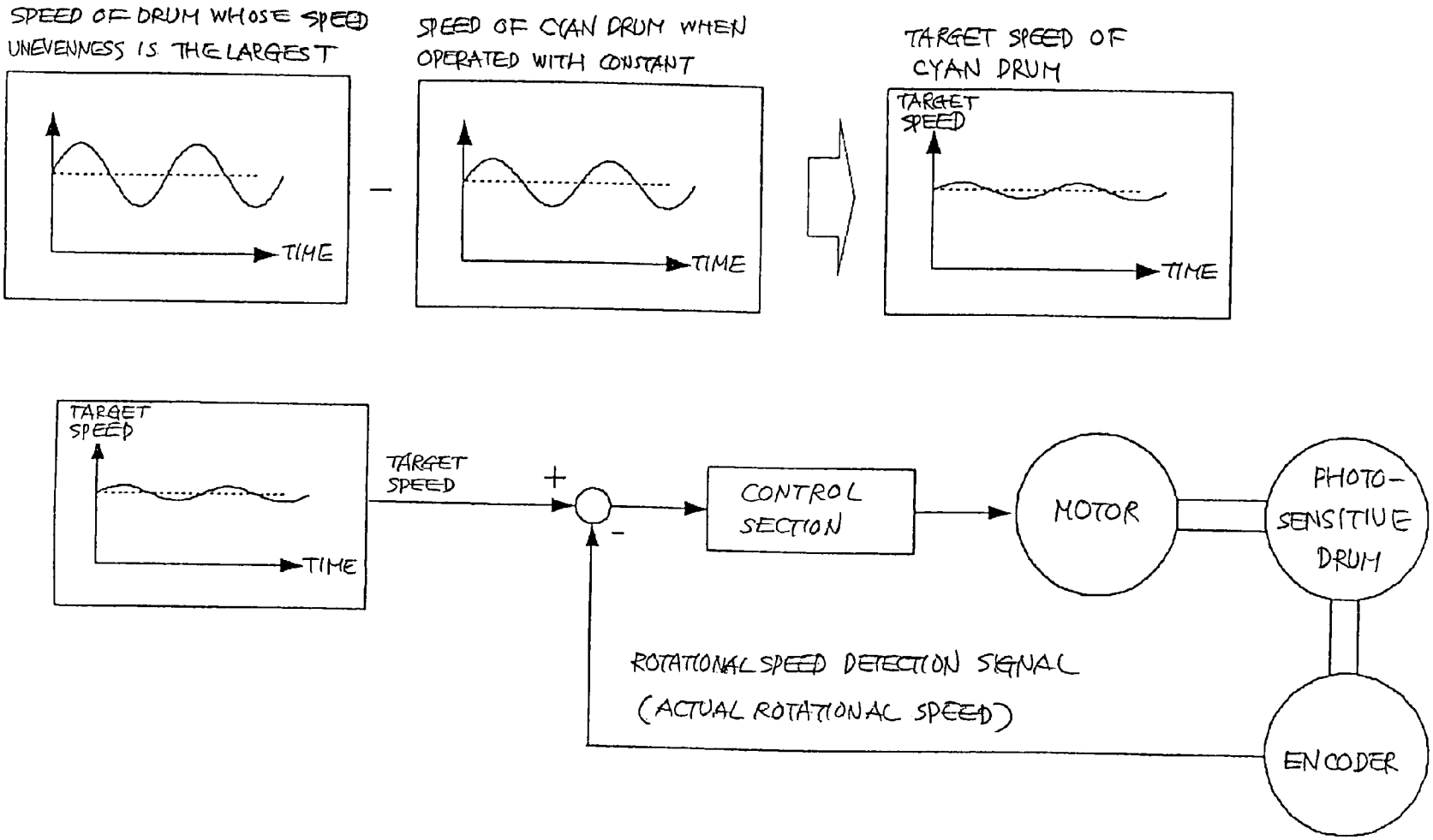

FIG. 3 shows the construction of the speed control means illustrated in Laid-open Japanese Patent Application No. 2002-72816 referred to above. In this case, the prior art control means is further provided with a second speed detection device. An arbitrary frequency component is extracted by Fourier transformation of the output of this speed detection device and is fed back to the target value of the speed. By employing this method, speed variation of an arbitrary frequency component can be suppressed.

However, these examples of prior art were still subject to problems requiring solution, as described above.

Embodiments of the present invention that solve these problems of the prior art are described in detail below with reference to the Figures.

First Embodiment

This embodiment consists in an image forming apparatus wherein phase correction is performed by detecting the rotational speed unevennesses of the photosensitive drums and finding phase correction values from the distances between the photosensitive drums, and exercising control such that the speeds of the other photosensitive drums are matched with the speed of the photosensitive drum that displays the largest speed unevenness.

Figure 8:
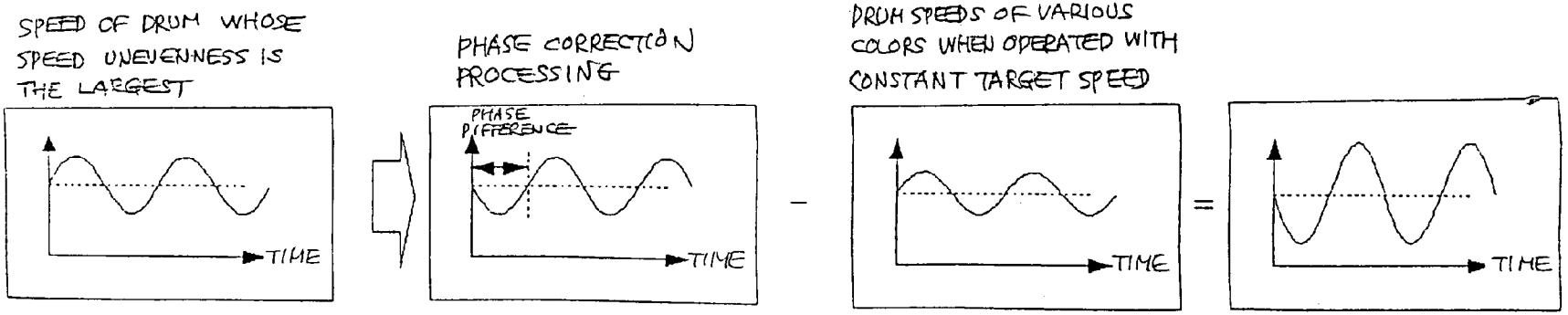
FIG. 8 is a diagram showing a method of calculating a phase correction in the image forming apparatus according to the first embodiment.
Figure 9:
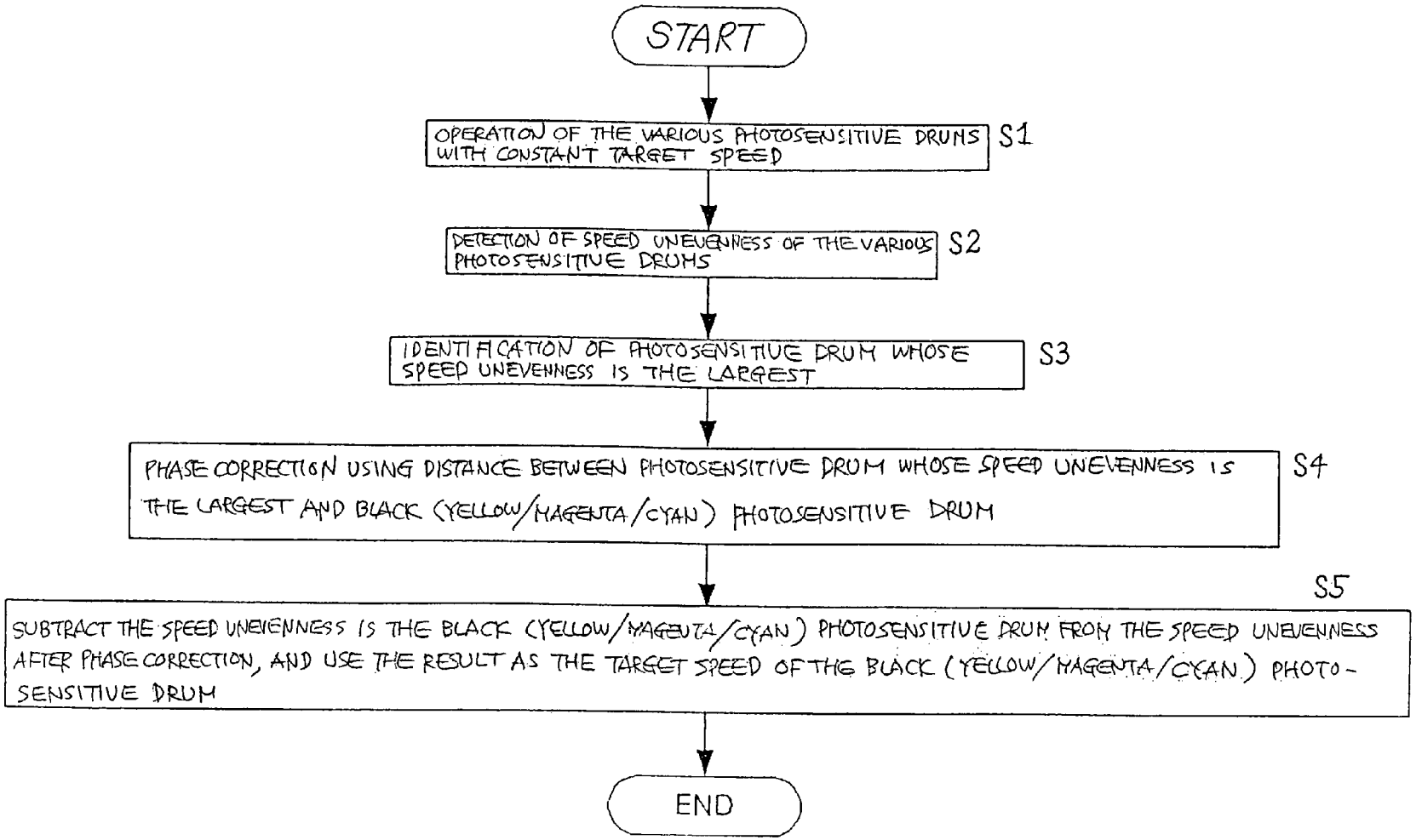
FIG. 9 is a flow chart showing a phase correction sequence in an image forming apparatus according to the first embodiment.

The basic construction of the image forming apparatus according to this embodiment is the same as that of the prior art. However, the section that controls rotational speed unevenness of a photosensitive drum differs from that of the prior art. FIGS. 4 to 7 show the diagrammatic construction of a photosensitive drum drive system of an image forming apparatus according to this embodiment; FIG. 8 shows a method of calculating a phase correction; and FIG. 9 shows a flow chart showing a phase correction sequence, respectively.

Next, the function and operation of the image forming apparatus according to this embodiment constructed as above will be described. First of all, the method of control will be described in outline with reference to FIGS. 4 to 7.

If the target value is taken as a constant speed, when results as shown in FIGS. 2A to 2D are obtained, of the speed variations generated in the photosensitive drums of various colors the largest variation of rotational speed of the photosensitive drums is displayed by the magenta photosensitive drum. In this case, as shown in FIGS. 4 to 7, the rotational speeds of the photosensitive drums of various colors other than magenta can be given a speed variation component similar to that of the magenta drum. by subtracting the speed variation component of each color from the speed variation component of the magenta drum and adding the results to the respective speed target values.

In this case, the speed variation of each of the photosensitive drums is larger than in the case of the prior art control system. However, if the distance between the drums of each color is the same as the drum peripheral length and the speed of the transfer belt (including the intermediate transfer belt, in the case of an image forming apparatus having such an intermediate transfer belt) is the same as the speed of the outer periphery of the drums, the relative speed of the photosensitive drums of each color at the transfer positions becomes 0. Consequently, the effect of speed variation does not appear as color offset in the resultant image. It should be noted that, in order to achieve such control, it is necessary to rotate each of the photosensitive drums simultaneously with the constant-speed target value. This may be performed on power-up or after occurrence of a paper blockage, for example, and data regarding the speed variation component stored on a recording medium.

Next, a method of calculating a phase correction will be described with reference to FIGS. 8 and 9.

The phase correction of the photosensitive drums is only zero if the distances between the drums of various colors are equal to the drum peripheral length and the speed of the transfer belt is equal to the speed of the drum periphery. By performing phase correction as shown in FIG. 8, even if the distance between the drums of various colors is different from the drum peripheral length, the phase difference can be made zero. However, the effect of transfer position error of various colors generated by mounting errors of the photosensitive drums or deterioration of the photosensitive drums cannot be removed.

The phase correction calculation sequence is as follows. In step S1 of the flow chart of FIG. 9, the photosensitive drums are operated with a constant target speed. In step S2, the speed unevenness of the photosensitive drums is detected. In step S3, the photosensitive drum that has the largest degree of speed unevenness is found. In step S4, phase correction is performed by finding the phase correction values from the distance between the drums in respect of the photosensitive drum whose speed unevenness is the largest and the other photosensitive drums. In step S5, the speed unevenness of the other photosensitive drums is subtracted from the speed unevenness after phase correction, to obtain the target speeds of the other photosensitive drums.

As described above, with this embodiment, color offset can be reduced by removing, in a relative fashion, phase differences and a speed variation component between the drums, by adoption of a construction of the image forming apparatus wherein rotational speed unevenness of the various photosensitive drums is detected and a phase correction is performed by finding a phase correction value from the distance between the photosensitive drums, and control is exercised such that the speed of the other photosensitive drums is matched with the speed of the photosensitive drum of largest speed unevenness.

Second Embodiment

This embodiment provides an image forming apparatus wherein a test image is output by detecting the rotational speed unevenness of the various photosensitive drums and exercising control such that the speed of the other photosensitive drums is matched with the speed of the photosensitive drum of largest speed unevenness; a phase correction is performed by finding a phase correction value from this test image, and control is again exercised such that the speed of the other photosensitive drums is matched with the speed of the photosensitive drum of largest speed unevenness.

Figure 10:
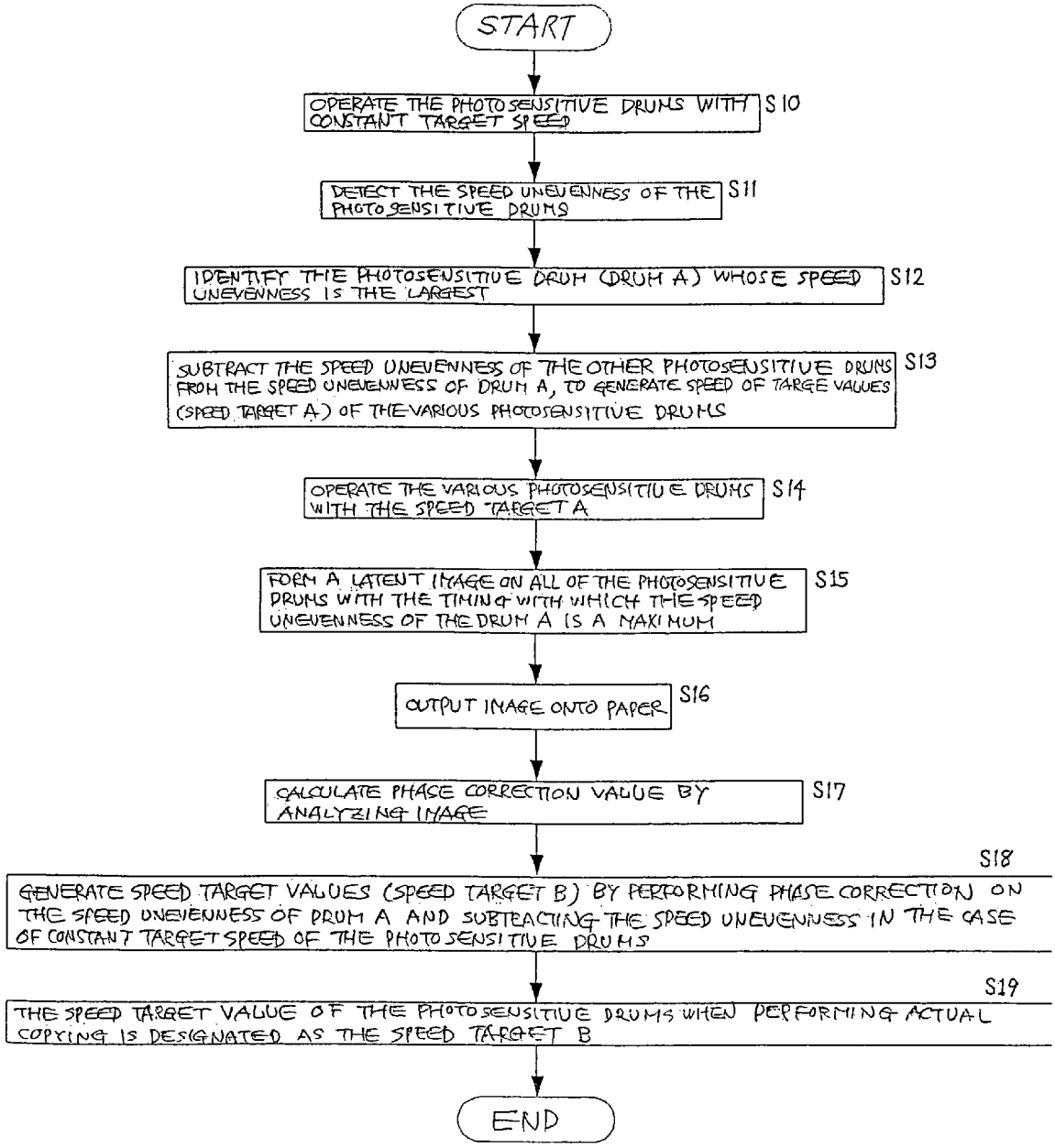
FIG. 10 is an operational flow chart of phase correction means of an image forming apparatus according to a second embodiment of the present invention.
Figure 11:
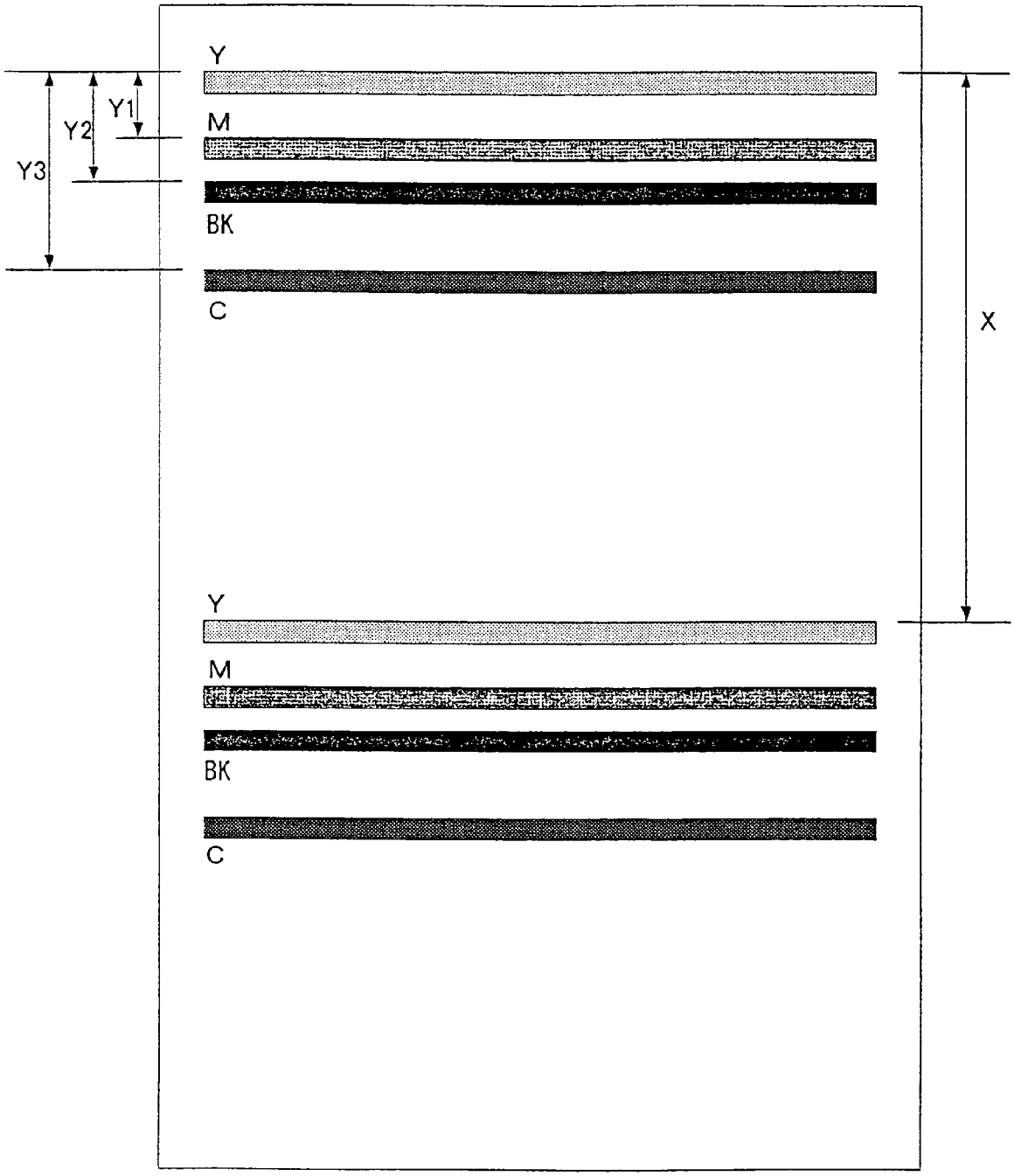
FIG. 11 is a view showing examples of images that are output in the case where the distance between drums of each color is different from the drum peripheral length and in the case where the speed of the transfer belt is different from the speed at the drum periphery, in an image forming apparatus according to the second embodiment.

The basic construction of the image forming apparatus according to this embodiment is the same as that of the above first embodiment. However, the section that finds the phase correction value of the photosensitive drums differs from that of the first embodiment. FIG. 10 is an operational flow chart of the phase correction means of the image forming apparatus according to this embodiment. FIG. 11 is a view showing examples of images that are output in the case where the distance between drums of each color is different from the drum peripheral length and in the case where the speed of the transfer belt is different from the speed at the drum periphery.

The operational sequence of phase correction means of an image forming apparatus in an embodiment constructed as described above will now be described with reference to FIGS. 10 and 11.

First of all, all of the photosensitive drums are given a speed variation component like that of the photosensitive drum whose speed variation component is largest (this drum is identified as drum A). Thereupon, a latent image is generated on all of the photosensitive drums in each period, with the timing with which the speed variation component of the drum A becomes a maximum. The image that is output when the distances between the drums of each of the colors are equal to the drum peripheral length and the speed of the transfer belt (including the intermediate transfer belt, in the case of an image forming apparatus having such an intermediate transfer belt) is equal to the speed of rotation of the drum periphery should be an image in which the four toner colors are superimposed.

However, if the distances between the drums of each of the colors are different from the drum peripheral length, or the speed of the transfer belt is different from the speed of the drum periphery, an image as shown in FIG. 11 is output. In this case, the separation (X) with which images of the same color are formed is the peripheral length of the photosensitive drum. These separations (Y1, Y2, Y3) of the image formed by the drum A and the images formed by the other photosensitive drums represent offsets of the distance between the drums from the drum peripheral length, or represent offsets caused by differences of speed at the drum periphery and speed of the transfer belt. Consequently, the phase difference of the photosensitive drums at the transfer positions of various colors can be made zero by setting:

Phase correction value=(separation formed by images of the same separation/separation of image formed by drum A and image formed by other photosensitive drum)×2Π

Changes over time produced by deterioration of for example the photosensitive bodies or changes of the transfer position produced by replacement of a photosensitive drum can be accommodated by periodically detecting the output image, using a reading device (scanner) attached to the image forming apparatus, and an image processing device (CPU or the like).

The processing sequence of phase correction is as follows.

The various photosensitive drums are operated with constant target speed in step S10 of the flow chart of FIG. 10. In step S11, the speed and unevenness of the photosensitive drums is detected. In step S12, the photosensitive drum that has the largest speed unevenness is found. In step S13, the speed unevenness of the other photosensitive drums is subtracted from the speed unevenness of the photosensitive drum whose speed unevenness is the largest, to find the provisional target speed of the other photosensitive drum. In step S14, the photosensitive drums are operated with the provisional target speed. In step S15, a latent image is formed on all of the photosensitive bodies with the timing with which the speed unevenness of the photosensitive drum of maximum speed unevenness is a maximum. In step S16, an image is output onto paper. In step S17, the phase correction values are found by analyzing the image. In step S18, phase correction of the photosensitive drum whose speed unevenness is a maximum is performed, and the actual target speeds are found by subtracting the speed unevenness of the other photosensitive bodies in the case of constant target speed. In step S19, the actual target speed is set as the speed target value of the photosensitive drums during actual copying.

As described above, in this embodiment, an image forming apparatus is constructed wherein a test image is output by detecting the rotational speed unevenness of the various photosensitive drums and exercising control such that the speed of the other photosensitive drums is matched with the speed of the photosensitive drum of largest speed unevenness; a phase correction is performed by finding a phase correction value from this test image, and control is again exercised such that the speed of the other photosensitive drums is matched with the speed of the photosensitive drum of largest speed unevenness; thus removing, in a relative fashion, phase differences and a speed variation component between the drums, and thereby enabling color offset to be reduced.

As described, with the various embodiments of the present invention, color offset can be reduced by a simple system by relative removal of phase difference and a speed variation component between the photosensitive drums.

Also, the method of controlling an image forming apparatus according to the present invention is ideal as a method of preventing color offset, by correcting rotational speed unevenness of the photosensitive drums of a tandem color image forming apparatus. This method may also be applied to rotational speed control devices of other servomotors.

Various modifications will become possible for those skilled in the art after receiving the teachings of the present disclosure without departing from the scope thereof.

What is claimed is:

1. An image forming apparatus, comprising:

a conveyor belt that conveys paper;

an intermediate transfer belt that transfers a toner image;

a plurality of photosensitive drums of the same shape adjacently arranged facing said intermediate transfer belt;

an image forming unit that forms a monochromatic toner image on each of said photosensitive drums;

rotational speed detection means that detects individually the rotational speed of said photosensitive drums and said intermediate transfer belt;

control means that controls individually the rotational speed of said intermediate transfer belt and said photosensitive drums, using the detected value of rotational speed;

transfer means that transfers toner images of various colors formed on said photosensitive drums onto said intermediate transfer belt in sequentially superimposed fashion;

drive means that rotates said photosensitive drums with a constant target speed when power is switched on;

speed unevenness detection means that detects speed unevenness of said photosensitive drums from the rotational speed detection means of said photosensitive drums;

phase correction means that performs phase correction on the speed of the photosensitive drum of largest speed unevenness; and target speed value calculation means that obtains a target speed value of said photosensitive drums by subtracting the speed unevenness of the other photosensitive drums from the speed value after phase correction.

2. The image forming apparatus as claimed in claim 1, wherein said phase correction means performs correction using a phase correction value calculated from the distance between photosensitive drums and the peripheral length of a photosensitive drum.

3. The image forming apparatus as claimed in claim 1, wherein said phase correction means corrects image data obtained by a toner image formed on an arbitrary photosensitive drum, in accordance with the results of analysis thereof performed using an image data analysis device.

4. The image forming apparatus as claimed in claim 3, wherein said image data analysis device comprises an image processing device and an image reading device attached to the image forming apparatus.

* * * * *